United States Patent [19]

Roerig et al.

[11] Patent Number: 4,790,908

[45] Date of Patent: Dec. 13, 1988

[54] EXTENDED NIP PRESS BELT GUIDE AND METHOD

[75] Inventors: Arnold J. Roerig; David V. Lange, both of Beloit, Wis.

[73] Assignee: Beloit Corporation, Beloit, Wis.

[21] Appl. No.: 157,674

[22] Filed: Feb. 19, 1988

[51] Int. Cl.[4] ..... D21F 3/00

[52] U.S. Cl. ..... 162/199; 162/252; 162/272; 162/358; 100/154; 198/806; 474/101

[58] Field of Search ..... 162/272, 263, 305, 358, 162/199, 198, 256, 257, 252; 100/118, 154; 198/806, 807, 810, 840; 474/101–104

[56] References Cited

U.S. PATENT DOCUMENTS

| | | | |
|---|---|---|---|
| 2,635,475 | 4/1953 | Hornbostel | 474/104 |
| 2,869,866 | 1/1959 | Lorig | 226/192 |
| 3,750,920 | 8/1973 | Fountain et al. | 226/23 |
| 3,775,241 | 11/1973 | Justus et al. | 162/199 |
| 4,173,904 | 11/1979 | Repetto | 474/104 |
| 4,272,317 | 6/1981 | Roerig | 162/272 |
| 4,629,061 | 12/1986 | Crandall | 474/102 |
| 4,705,602 | 11/1987 | Dahl | 162/358 |
| 4,713,147 | 12/1987 | Saarinen | 162/358 |

FOREIGN PATENT DOCUMENTS

| | | | |
|---|---|---|---|
| 620276 | 5/1961 | Canada . | |
| 2071598 | 9/1981 | United Kingdom | 198/807 |

*Primary Examiner*—David L. Lacey
*Assistant Examiner*—K. M. Hastings
*Attorney, Agent, or Firm*—Dirk J. Veneman; Raymond W. Campbell; Gerald A. Mathews

[57] ABSTRACT

An extended nip press has a looped belt mounted over a shoe having a concave surface which presses the belt against a mating surface on a roll to provide an extended nip. The shoe has a support which is movable in a skewing sense relative to the longitudinal axis of the roll. Lateral movement of the belt is monitored. When it has moved beyond predetermined limits in either direction, the shoe is skewed to alter the frictional forces on the belt as it passes over the shoe's surface. This controls the position of the belt and keeps it centered in the nip.

5 Claims, 1 Drawing Sheet

EXTENDED NIP PRESS BELT GUIDE AND METHOD

BACKGROUND OF THE INVENTION

This invention relates to web pressing. More particularly, the invention relates to the presing of a traveling web, such as paper, freshly formed from an aqueous slurry of fibers in a press which includes a non-rotating press member, such as a shoe. Still more particularly, this invention relates to a press of the type known in the papermaking industry as an extended-nip press wherein the web of paper travels through an area of contact between a moving surface, such as a rotating roll, and a felt and belt carried on the roll surface and pressed against it by a pressurized shoe having a face with a contour matching an arcuate portion of the roll surface.

While such extended-nip type presses are relatively new in the papermaking industry, there have been numerous installations and various types of configurations. Common to all extended nip presses is the use of one or more looped, flexible belts which travel through the nip with the paper web and one or more felts. One side of the belt contacts the web or felt, and its other side is in sliding contact with a stationary element, commonly referred to as a shoe, which provides a surface area of contact.

Since all machinery is not perfectly aligned, and in view of the inevitable deflection, however slight, across the span of a papermaking machine, and other small variations in the tolerances, construction or operation of the apparatus, the belt tends to migrate to one end of the press or the other during operation. In the past, this undesirable operating characteristic has been corrected by various means, such as by using movable guide rolls within the looped belt. Another manner of guiding the belt has been to mount the edges of the belt over a rotatable disc disposed on either end of the press which maintains the edges of the belt in a desired position relative to the extended nip during operation. Finally, guide plates have been utilized within the looped belt to maintain its location relative to the nip.

However, each of these prior methods of maintaining the belt in a desired position during operation of the extended-nip press has serious deficiencies. For example, guide rolls and guide plates disposed within the belt require additional equipment and produce additional friction, or drag, in the belt while performing their function of maintaining belt guidance.

The belt guide incorporating a rotating disc at either side of the belt perhaps provides the most positive belt guidance, but also produces the most serious deficiency because the discs, in order to operate effectively, must be biased axially outwardly, such as with springs, so the belt is under a tension in the cross machine direction. This stresses the belt and greatly increases its rate of wear since the belt is flexed through the nip in the direction toward the longitudinal axis extending across the machine while it is simultaneously being biased outwardly by the rotating discs.

SUMMARY OF THE INVENTION

The abovementioned deficiencies and shortcomings of prior devices for guiding the belt in an extended-nip press are obviated by this invention. Here, the shoe over which the moving belt is sliding while passing through the extended nip, is mounted for skewing movement relative to the nip. This is accomplished by mounting the shoe in a piston block which, in turn, is mounted in a beam extending longitudinally in the cross machine direction. This beam is, in turn, connected to a framework which is movable by a motorized jackscrew attached at one end, or both ends, of the framework. The skewing movement is facilitated by providing pivoted support rods which support the beam on which the extended-nip press shoe piston block is mounted to the framework of the rotatable roll. These support rods have two pivots at either end to permit the rods to pivot in both the machine and cross machine directions.

A control apparatus monitors the location of the belt edge and signals a motor driving a jackscrew to skew the end of the beam on which the shoe is mounted in a direction whereby the rotating belt is urged toward the center of the press. Since the belt and extended-nip press shoe are already integral parts of the press, no additional guides or rolls are required to effect the guiding operation. Also, since the belt must pass through the extended nip anyway, during the normal course of operation, the energy requirement for effecting the guidance of the belt is virtually nil. All that is required is to slightly shift the well-lubricated pivoted framework slightly with the motorized jackscrew.

Accordingly, it is an object of this invention to provide an apparatus for efficiently and effectively guiding the belt in an extended-nip press without the use of additional guide rolls or surfaces.

Still another object of this invention is to provide an apparatus for guiding the belt in an extended-nip press wherein the power requirements for such guidance are minimized.

Another object of the invention is to provide an apparatus for guiding the belt in an extended nip-press which does not stress the belt in addition to the stress it encounters during its passage through the nip.

These and other objects, features and advantages of the invention will become readily apparen to those skilled in the art when the accompanying drawings are viewed in conjunction with the description of the preferred embodiment described below.

IN THE DRAWINGS

DESCRIPTION OF THE PREFERRED EMBODIMENT

Figure 1:
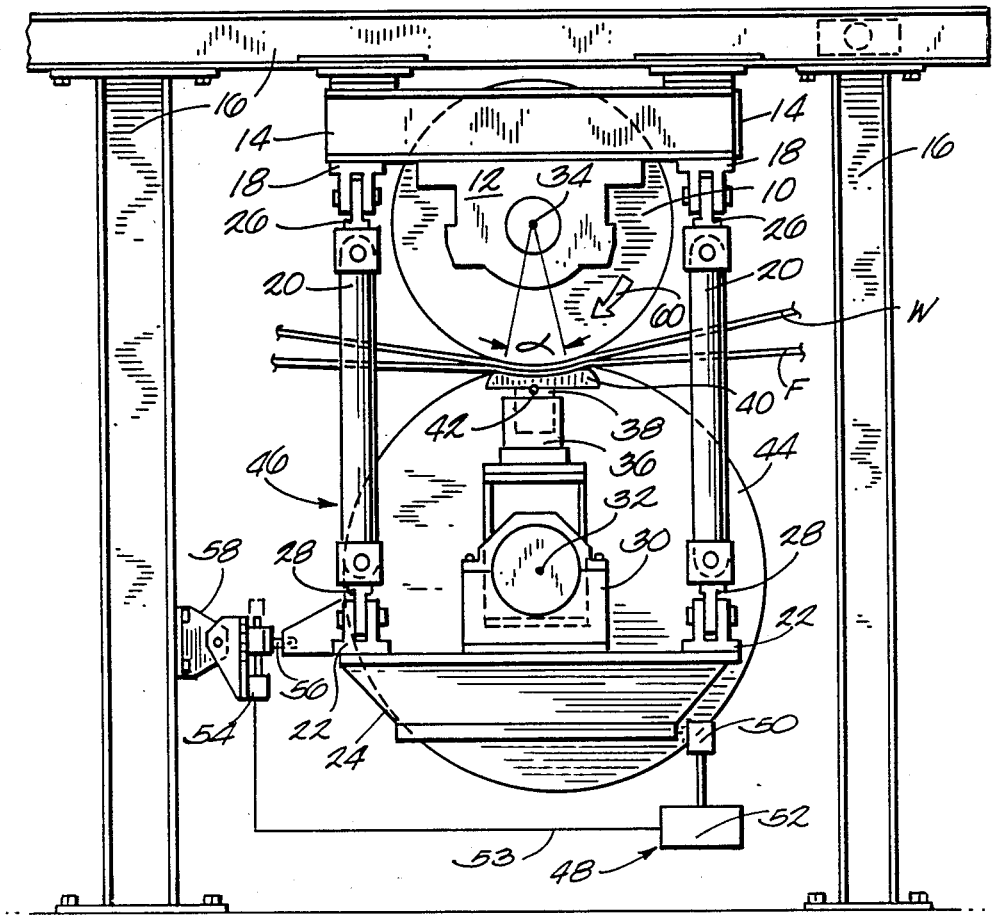
FIG. 1 is an end elevational view of the extended-nip press showing the manner in which the press shoe is mounted for skewing movement relative to the surface of the backing roll.

As shown in FIG. 1, a backing roll 10 for an extended- nip press is mounted with its bearing housing 12 on either end bolted to a short backing roll beam 14 which, in turn, is attached to its corresponding side of the papermaking machine press framework 16. The short beams 14 extend in the so-called machine direction, which is the direction the web of paper travels as it is formed in the papermaking machine. Mounted to the short beam 14 at either end of backing roll 10 are a pair of clevises 18, one at either side of each end of the backing roll, and a support rod 20 is pivotally attached to each clevis and extends downwardly where its other end is pivotally attached to a clevis 22 on either end of a corresponding lower press beam 24 on each side of the press frame.

The clevises 18, 22 permit the rods to pivot in the cross-machine direction which is at right angles to the machine direction. The upper and lower ends of the support rods are, in turn, pivotally mounted in corresponding upper and lower couplings 26,28 in their clevises for pivotal movement of the rod in the machine direction A support beam 30 is mounted on either end to the lower press beam 24. The support beam 30 thus extends longitudinally in the cross-machine direction with its longitudinal axis 32 parallel with the longitudinal axis of rotation 34 of backing roll 10. A piston block 36 is mounted on the support beam 30 and coextends with it in the cross-machine direction. As is well-known in the extended nip press art, such a piston block includes an open cavity toward the press nip in which a piston 38 is mounted for slidable reciprocal motion by the application of pressurized fluid against its lower surface within the cavity. The sides of the piston 38 are sealed for such sliding motion such that little or no pressurized fluid escapes beyond the sides of the reciprocating piston.

On top of the piston is mounted a stationary shoe 40. The upper surface of shoe 40 is concavely contoured to provide a surface which either coincides with the curvature of the surface of backing roll 10, or has its surface formed of a slightly larger radius to provide a slight gap at its upstream and/or downstream edges to permit lubricating fluid to enter between the belt and its surface, as will be described in more detail below.

The shoe 40, in its normal operating position, coextends in the cross-machine direction with the axis of rotation 34 of the backing roll l0and the longitudinal axis of the support beam. In the preferred embodiment, shoe 40 is pivotally mounted to the piston 38 by a small cylindrical rod 42 whose longitudinal axis also coextends with both the axis of rotation 34 of the backing roll and the longitudinal axis 32 of the support beam 30.

Disposed over the top of the shoe 40, and about the support beam 30, is a looped, flexible belt 44. Typically, belt 44 is formed of a woven mat covered with an elastomeric compound, such as rubber. This belt 44, support beam 30, support rods 20, piston block 36 and shoe 40 can be collectively referred to as the extended-nip press loading apparatus 46. The belt 44 extends in the cross-machine direction between the lower press beams 24 on either side of the press for substantially the length of shoe 40. Somewhere about the circumference of the looped belt 44 is mounted a belt edge position sensing apparatus 48 which, for example, can comprise a palm guide or paddle 50 mounted to a control apparatus 52 which provides signals through wire 53 to actuate a motor 54 to turn in one direction or the other according to the position of the edge of the looped belt relative to a predetermined, centered position in the press. The motor 54 is mounted to a vertical beam of press frame 16 and has its driveshaft connected to a jackscrew 56 which has one end connected to a bracket 58 which, in turn, is attached to frame 16. The other end is attached to the lower press beam 24. The connection of lower press beam 24 to a vertical beam of frame 16 through motor 54, jackscrew 56 and bracket 58 stabilizes the extended-nip loading apparatus relative to backing roll 10.

In operation, the piston 38 is actuated by hydraulic fluid by means, not shown, such as a pump, to forcefully position the shoe 40 against the surface of the backing roll with the paper web W and felt F between the belt 44 and the backing roll surface. As the paper web, felt and belt pass through the area of contact provided between the concave contour of the shoe 40 and the backing roll surface, water is expressed from the paper web into the felt. The web is thus compacted and dried to a further extent while passing through the extended nip which is substantially defined by the arcuate surface subtended by the angle $\alpha$ of the belt, felt and web between the shoe over the backing roll 10. The direction of travel for the belt, felt and paper web is in the direction corresponding to the arrow 60 on the backing roll 10. The pressurized force of contact of the belt, felt and web against the surface of the backing roll by action of the pressurized shoe provides the driving force for moving the belt in its looped path of travel.

When, during operation, the belt 44 tends to migrate in the longitudinal direction beyond a predetermined place on either end of the extended-nip press (i.e. in the cross-machine direction), such movement is sensed by the palm 50 of the control apparatus 52 which signals the motor 54 to rotate the jackscrew 56 in a direction whereby the end of the shoe 40 is moved in a skewing motion, under the constraint of the pivoted support rods 20, in a direction such that the traveling belt is urged by the frictional forces of its contact with the shoe surface to move inwardly toward the center of the papermaking machine, which is to say, toward the center of the extended-nip press.

Figure 2:
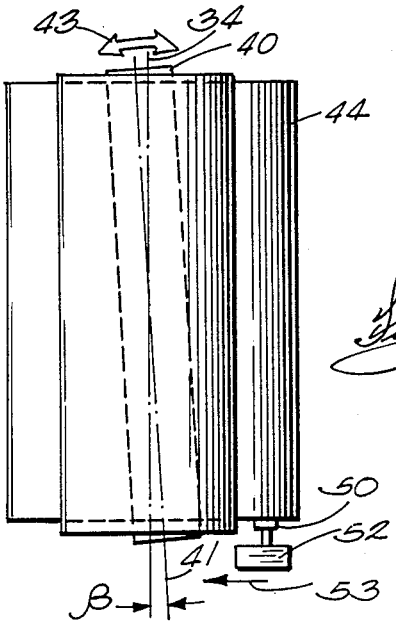
FIG. 2 is a top view, in somewhat schematic form, showing the shoe skewed relative to the backing roll axis of rotation.

This skewing movement is shown in exaggerated form, for purposes of illustration, as angle $\beta$ between the longitudinal axis 34 of backing roll 10 and the longitudinal axis 41 of shoe 40 in FIG. 2. The skewing motion is represented by the double-headed arrow 43. In other words, with reference to FIG. 1, the skewing motion is substantially in a horizontal plane which is tangent to the backing roll 10 at a point where a plane through its axis of rotation 34 and the longitudinal axis 32 of the support beam 30 passes through its surface. However, due to the pivoting of the support rods 20 in conjunction with the turning of the concave surface of the shoe 40 over the surface of the backing roll, the actual skewing motion may not be in a true horizontal plane.

Naturally, various modifications may be made in the apparatus without departing from the spirit or scope of the invention. For example, a motor 54, jackscrew 56 and bracket 58 may be mounted to either end of the apparatus to provide increased stability and operational control. Also, some other arrangement besides the support rods and pivoted clevises could be used to movably support the extended-nip loading apparatus 46. Finally, the surface of the roll could be skewed relative to the surface of the shoe.

What is claimed is:

1. In an extended nip web press having a frame, a rotatable roll having a longitudinal axis of rotation and a traveling pressing surface, said roll mounted to the frame, a looped felt and a looped belt corunning with a web through the extended nip in a path of travel, a shoe and shoe support means opposite the roll and located within the looped belt for providing nipping force between the belt and the roll surface, the improvement comprising: belt position sensing means for sensing lateral deviation of belt travel through the extended nip in either direction along the length of the nip and perpendicular to its path of travel, and for providing signals responsive to such movement of the belt; an actuator for receiving the signals and including means connected to the shoe support means structured for moving said shoe in a skewing motion relative to the roll surface and altering the path of belt travel and its position in the extended nip in response to said signals.

2. An extended-nip press as set forth in claim 1, wherein:

the shoe support means includes a piston block and an axial beam supporting the piston block and having a longitudinal axis co-extending with the longitudinal axis of the roll.

3. An extended-nip press as set forth in claim 2, wherein:

the shoe support means further includes support rods linking the axial beam with the frame on which the roll is mounted;

the support rods include pivots permitting said skewing motion of the shoe relative to the roll surface.

4. An extended-nip press as set forth in claim 1, wherein:

the belt position sensing means includes a palm guide for contacting an edge of the belt, control apparatus for providing the signals responsive to lateral movements of the belt as sensed by the palm guide, and the actuator means includes a motor operatively linked to the control apparatus, and a jackscrew driven by the motor and linked with the shoe support means for providing lateral positioning movement of the shoe support means to move the shoe in said skewing motion and position the traveling belt longitudinally therealong.

5. A method of guiding the belt in an extended-nip web press having two lateral ends and a center in between said ends, and having a frame, a backing roll having a pressing surface, a looped felt and a looped belt co-running with a web over a portion of the backing roll pressing surface, a shoe located within the looped belt and having a surface defining, with the belt and the roll pressing surface, the extended nip, the steps comprising:

monitoring the lateral position of the belt as the belt migrates in a longitudinal direction beyond a predetermined place on either of said lateral ends of the extended nip press as the belt travels in the press;

providing signals responsive to the lateral position of the belt as it travels through the press;

moving and the shoe in a skewing motion relative to the surface of the roll in response to the signals, whereby the friction of the belt passing through the nip changes along the nip across the machine to cause the belt to move toward the center of the press.

* * * * *

UNITED STATES PATENT AND TRADEMARK OFFICE

CERTIFICATE OF CORRECTION

PATENT NO. : 4,790,908

DATED : December 13, 1988

INVENTOR(S) : Arnold J. Roerig, et al

It is certified that error appears in the above-identified patent and that said Letters Patent is hereby corrected as shown below:

Title page, item [75]:

The following name should be added to the list of inventors

--Dale A. Brown
Milton, WI--.

Signed and Sealed this

Twenty-first Day of February, 1989

*Attest:*

DONALD J. QUIGG

*Attesting Officer*

*Commissioner of Patents and Trademarks*